US007667399B2

(12) United States Patent
Contarino et al.

(10) Patent No.: US 7,667,399 B2
(45) Date of Patent: Feb. 23, 2010

(54) LARGE AREA HYBRID PHOTOMULTIPLIER TUBE

(75) Inventors: Vincent Michael Contarino, Lusby, MD (US); Pavlo Molchanov, Lexington Park, MD (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 363 days.

(21) Appl. No.: 11/801,771

(22) Filed: Apr. 26, 2007

(65) Prior Publication Data

US 2008/0265769 A1 Oct. 30, 2008

(51) Int. Cl.
*H01J 43/04* (2006.01)
*H01J 40/16* (2006.01)
*H01J 40/06* (2006.01)

(52) U.S. Cl. ..... 313/532; 313/541; 313/542

(58) Field of Classification Search ..... 313/532, 313/103 R, 103 CM, 542, 544, 541; 250/207, 250/214 VT See application file for complete search history.

(56) References Cited

U.S. PATENT DOCUMENTS 5,192,861 A * 3/1993 Breskin et al. ..... 250/214 VT
5,326,978 A 7/1994 Aebi et al.
5,374,826 A 12/1994 LaRue et al.
5,475,227 A 12/1995 LaRue
5,654,536 A 8/1997 Suyama et al.
5,684,360 A * 11/1997 Baum et al. ..... 313/542
5,917,282 A 6/1999 Suyama et al.
6,166,365 A 12/2000 Simonetti et al.
6,297,489 B1 10/2001 Suyama et al.
7,282,701 B2 * 10/2007 Kok et al. ..... 250/234
2002/0024300 A1 * 2/2002 Ferenc ..... 313/523

OTHER PUBLICATIONS

M.Suyama,A.Fukasawa,J.Haba,T.Iijima.S.Iwata . . . Development of Multi-pixel hybrid photo-detector with high quantum efficiency and gain, Nuclear Science Symposium, 2003 IEEE vol 2.

C.Joram, Large Area Hybrid Phtodiodes, Nuclear Physics B—Proceedings Supplements vol. 78, Issues 1-3, Aug. 1999, pp. 407-441.

Suyama et al., A Compact Hybrid Photodetector, IEEE Transactions on Nuclear Science, vol. 44, No. 3, Jun. 1997, pp. 985-989.

* cited by examiner

*Primary Examiner*—Karabi Guharay
*Assistant Examiner*—Sheryl Hull
(74) *Attorney, Agent, or Firm*—Mark O. Glut

(57) ABSTRACT

A large area hybrid photomultiplier tube that includes a photocathode for emitting photoelectrons in correspondence with incident light, a semiconductor device having an electron incident surface for receiving photoelectrons from the photocathode, and a cone shaped container. The container has a first opening and a second opening. The photocathode is disposed at the first opening, and the semiconductor device is disposed at the second opening.

16 Claims, 2 Drawing Sheets

LARGE AREA HYBRID PHOTOMULTIPLIER TUBE

STATEMENT OF GOVERNMENT INTEREST

The invention described herein may be manufactured and used by or for the Government of the United States of America for governmental purposes without payment of any royalties thereon or therefor.

BACKGROUND

The present invention relates to a hybrid photomultiplier tube used for the detection of weak signals, electrons or ions. More specifically, but without limitation, the present invention relates to a large area hybrid photomultiplier tube for detection of reflected signals from target weak light signals, more particularly, for use in laser systems, underwater systems, airborne systems, astronomic systems, geophysics remote sensing systems, distance measurement and imaging systems.

Conventional photodetectors or photomultipliers include at least one photocathode to emit photoelectrons in correspondence with incident light, a semiconductor device having an electron incident surface for receiving the photoelectrons from the photocathode, the electron incident surface being arranged so as to face the photocathode, and a confining mechanism or focusing electrodes arranged between the photocathode and the electron incident surface to confine orbits of the photoelectrons from the photocathode. Typical photodetectors known in the art can be damaged by positive ions, tube electrodes may be short circuited, and/or have operational instability.

Thus, there is a need in the art to provide a large area hybrid photomultiplier tube without the limitations inherent in present methods.

SUMMARY

It is a feature of the invention to provide a large area hybrid photomultiplier tube that includes a photocathode for emitting photoelectrons in correspondence with incident light, a semiconductor device having an electron incident surface for receiving photoelectrons from the photocathode, and a cone shaped container. The container has a first opening and a second opening. The photocathode is disposed at the first opening, and the semiconductor device is disposed at the second opening.

It is a feature of the invention to provide a large area hybrid photomultiplier tube that is operationally stable and provides better time characteristics in comparison with conventional photomultipliers.

It is a feature of the invention to provide a large area hybrid photomultiplier tube that does not create positive ions inside the photomultiplier tube, thus preventing positive ion damage to the photocathode.

DRAWINGS

Figure 1:
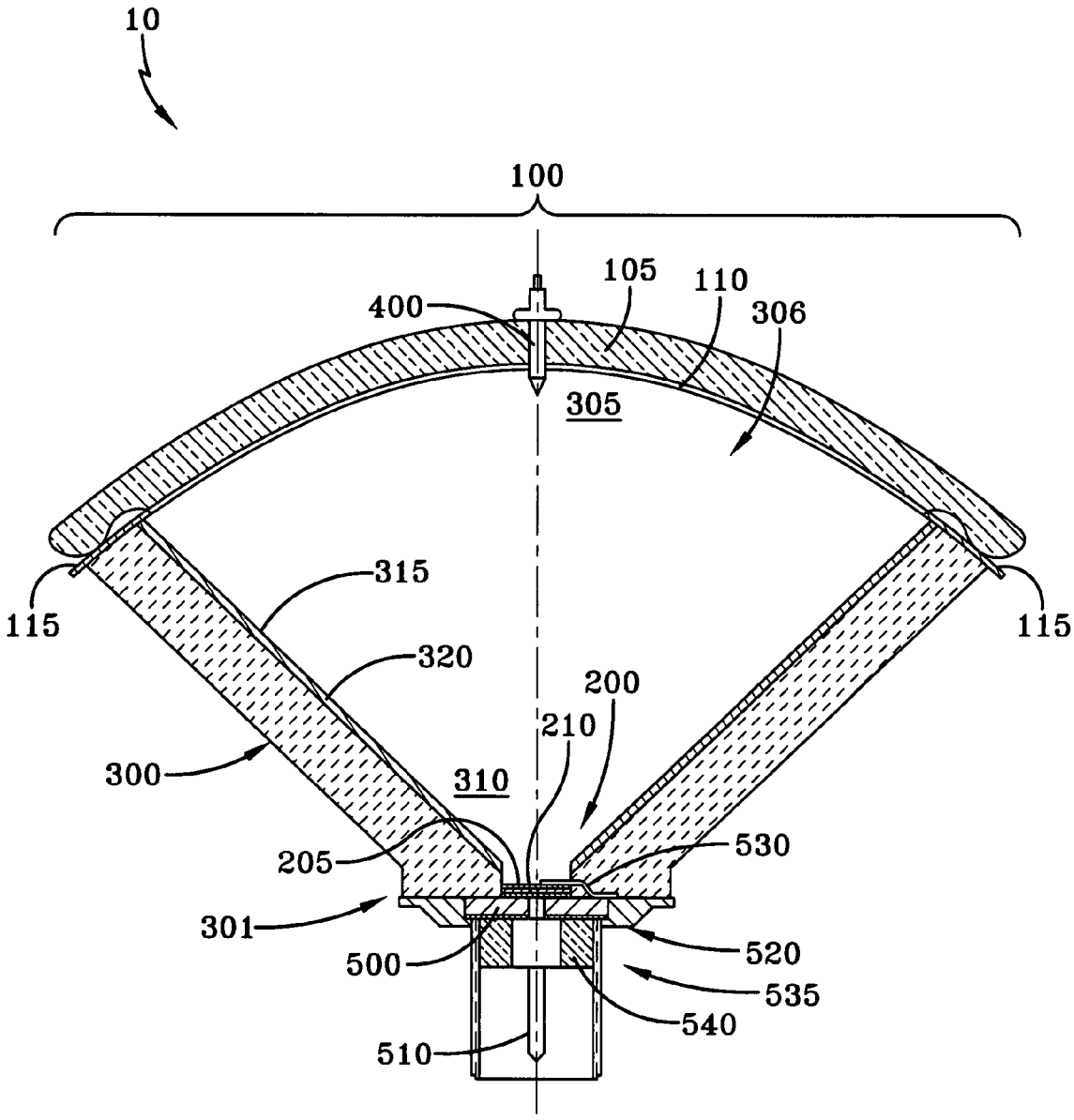
Figure 2:
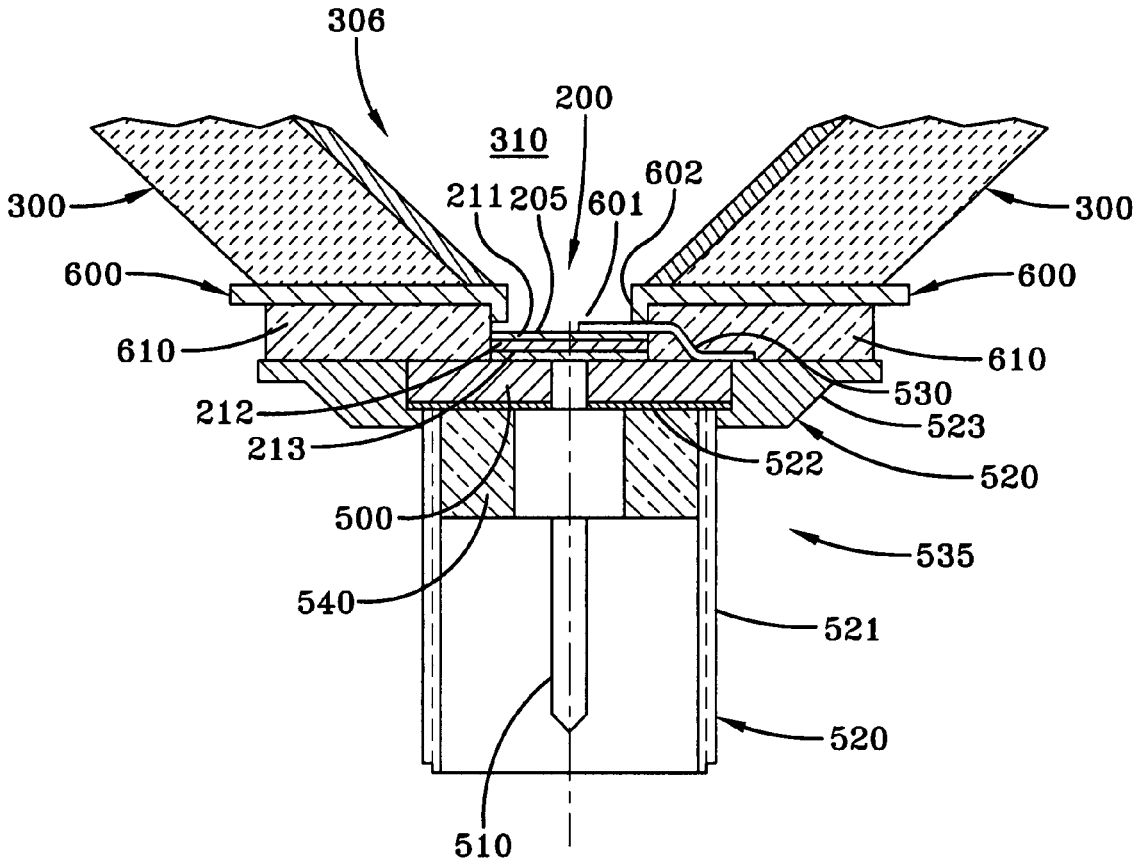

These and other features, aspects and advantages of the present invention will become better understood with reference to the following description and appended claims, and accompanying drawings wherein:

FIG. 1 is a cross sectional view of an embodiment of the large area hybrid photomultiplier tube; and, FIG. 2 is a cross sectional view of an embodiment of a section of the large area hybrid photomultiplier tube, specifically the section at or near the second opening of the container.

DESCRIPTION

The preferred embodiment of the present invention is illustrated by way of example below and in FIGS. 1 and 2. As shown in FIG. 1, the photomultiplier tube 10 includes a photocathode 100, a semiconductor device 200, and a container 300. The photocathode 100 emits photoelectrons in correspondence with incident light. The semiconductor device 200 has an electron incident surface 205 for receiving photoelectrons from the photocathode 100. The container 300 has a first opening 305 and a second opening 310, with the photocathode 100 disposed at the first opening 305, and the semiconductor device 200 disposed at the second opening 310.

In the description of the present invention, the invention will be discussed in a laser radar environment; however, this invention can be utilized for any type of need that requires use of a photomultiplier tube or photodetector.

A photocathode 100 may be defined, but without limitation, as an electrode used for obtaining photoelectric emission when irradiated, or a conductor through which a current enters or leaves an electric or electronic device. As shown in FIG. 1, the photocathode 100 is disposed at the first opening 305 of the container 300. The photocathode 100 may include a glass portion 105, a photosensitive layer 110 and a photocathode electrode 115. The glass portion 105 may be disposed on the photosensitive layer 110, while the photosensitive layer 110 is electrically connected to the photocathode electrode 115. The glass portion 105 may be disposed adjacent to the first opening 305 and adjacent to the interior 306 of the container 300. In one of the embodiments of the invention, as shown in FIG. 1, the photosensitive layer 110 may be disposed between the glass portion 105 and the interior 306 of the container 300. The glass portion 105 may be spherically shaped, convex shaped, curved, cone shaped, flat, or any shape practicable. In the preferred embodiment, the glass portion 105 has a convexo-concave shape or similar to a portion of a hollow sphere, and the photosensitive layer 110 is similarly shaped to the glass portion 105, and the photocathode electrode 115 is disposed along the edge or outer diameter of the photosensitive layer 110. In one of the embodiments of the invention, the photosensitive layer 110 is curved or spherically curved or shaped and corresponds to the glass portion 105, and the photocathode electrode 115 is ring shaped and is disposed around the outer diameter of the photosensitive layer 110.

The container 300 may be a cone shaped container as shown in FIG. 1, a trapezoid shaped container, a pyramid shaped container, or any shape practicable. The container 300 is a vacuum container and may be manufactured from ceramic, glass, any type of composite material or any material practicable. The inner surface 315 of the container 300 may be covered by resistive material 320. The resistive material 320 may be, but without limitation, graphite. The photocathode 100 and the semiconductor device 200 are disposed at their respective openings 305, 310 of the container 300 such that they create a vacuum within the interior 306 of the container 300.

When utilizing a cone shaped container 300 or a pyramid shaped container, in the preferred embodiment of the invention, the second opening 310 of the container is disposed at the vertex 301 of the cone or pyramid container 300 (the vertex 301 of the container 300 may be defined, but without limitation, as the end with the smaller sized cross sectional area or the tip portion of the conic section formed by the cone shaped container 300). Thus, the electron incident surface 205 of the semiconductor device 200 is mounted near or on an inner surface of the vertex 301 of the cone or pyramid container 300. This avoids bombardment of electrons arriving at portions other than the electron incident surface 205 of the semiconductor device 200. Furthermore, it prevents creating positive ions inside the photomultiplier tube 10 and damage to the photocathode 100, as well as providing a long period of operation and improving noise factor.

As seen in FIG. 1, in the preferred embodiment of the cone shaped container 300 (as well as in the pyramid shaped container 300), the first opening 305 is larger than the second opening 310. In the cone shaped container, the trapezoid shaped container and the pyramid shaped container embodiments of the invention, the second opening 310 has an area not greater than that of the electron incident surface 205 of the semiconductor device 200.

A collector of positive ions 400 may be disposed in the center of the photocathode 100. The collector 400 may be an electrode and manufactured from a conductive material, such as, but without limitation, a kovar metal (a kovar metal may be defined, but without limitation, as metal in the group of alloys which show a sharp change in the coefficient of expansion at certain temperatures). As shown in FIG. 1, the collector of positive ions 400 may be welded in the center of the photocathode 100 (specifically at the longitudinal and latitudinal center or at the positional pole of the photocathode or at an area at the approximate center of the first opening 305 of the container 300). As seen in FIG. 1, the collector of positive ions 400 may be disposed and extend through the glass portion 105 and the photosensitive layer 110. In the preferred embodiment, the collector of positive ions 400 is substantially perpendicular to the glass portion 105 and the photosensitive layer 110 and extends entirely through the glass portion 105 and the photosensitive layer 110. The collector of positive ions 400 may be extended in length or diameter for a particular tube size and dimension ratio.

As discussed above, the semiconductor device 200 includes an electron incident surface 205 that is disposed at the second opening 310 of the container 300. In the preferred embodiment, the semiconductor device 200 may include one or more semiconductor diodes 210. The semiconductor diode 210 may include three separate layers formed on an n+GaAs substrate. As shown in FIG. 2, the layers include a top layer 211, a middle layer 212, and a bottom layer 213. In the preferred embodiment, the top layer 211 is doped to be a p-type $Al_{30}Ga_{70}As$ layer approximately 250 A thick and may form the electron incident surface 205 (or at least a portion of it). The top layer 211 provides a potential barrier near the surface of the semiconductor diode 210 to keep generated electron minority carries from recombining at the surface. The composition of the top layer 211 is also chosen for stability and for its resistance to oxidation during processing in air. In the preferred embodiment, the middle layer 212 is doped to be p-type GaAs approximately 0.25 microns thick, while the bottom layer 213 is undoped GaAs and is approximately 6 microns thick.

The semiconductor device 200 may be mounted on a ceramic isolator 500 and connected to a coaxial feedthrough central conductor 510. The coaxial feedthrough central conductor 510 may be attached to a cable (not shown), which can transmit any type of electrical signal. The signal may be transmitted to processor, computer or any type of acceptor of signals. The ceramic isolator 500 may be an annulus with an aperture axially extending such that the coaxial feedthrough central conductor 510 may partially be in the aperture of the ceramic isolator 500.

The photomultiplier tube 10 may also include a collecting anode 535. The collecting anode 535 may include the semiconductor device 200. The collecting anode 535 may include an external conductor 520. The external conductor 520 may include an annular section 521, a disk section 522 and a flange section 523. At one of the ends of the annular section 521, the disk section 522 and the flange section 523 may be disposed, preferably at the end closest to the container 300. The annular section 521, the disk section 522 and the flange section 523 may all be axially aligned. The disk section 522 may be ring like, with an outer diameter larger than the annular section 521. The flange section 523 may be ring like and disposed on the outer edge or outer diameter of the disk section 523 (as well as the outer diameter of the ceramic isolator 500). In one of the embodiments of the invention, the disk section 522 and the ceramic isolator 500 may be the same element. The top layer 211 of the semiconductor device 200 can be connected to the external conductor 520 (specifically the disk section 522) by a very thin conductor 530 and via the ceramic isolator 500. The collecting anode 535 forms the matched load requirements for transmission of high frequency signals. The coaxial feedthrough central conductor 510 functions as a part of the vacuum container 300 of the photomultiplier tube 10 for coupling the output signal externally of the vacuum. The coaxial feedthrough central conductor 510 may be insulated and/or enveloped by glass 540 and may be fixed to (and/or disposed within) the external conductor 520 and the ceramic isolator 500.

As shown in FIG. 2, the photomultiplier tube 10 may also include a confining electrode 600. The confining electrode 600 may be embedded in the container 300 at or near the second opening 310, or at or near the vertex 301 of the container 300. The confining electrode 600 may be ring like and have an opening 601, which contributes to confine the spread of photoelectrons. The opening 601 of confining electrode 600 corresponds to the interior 306 of the container 300 and has the area not greater than that of the second opening 310 of the container 300, and avoids bombardment of electrons arriving at portions other than the electron incident surface 205 of the semiconductor device 200. The confining electrode 600 may further include a lip 602 that is disposed on the inner diameter of the confining electrode 600.

The confining electrode 600 may be isolated from the external conductor 520 of the collecting anode 535 by a ring 610. The ring 610 may be manufactured, but without limitation, from a ceramic or glass. The confining electrode 600 is applied with a predetermined voltage from an external voltage source (not shown) and held at positive or negative potential of about 0-200 volts depending on electron incident surface size.

In operation, light enters the photocathode 100, specifically through the glass portion 105. An accelerate voltage on the order of about 4-12 kV is typically applied between the photocathode electrode 115 and the collection anode 535 (and/or semiconductor device 200) of the hybrid photomultiplier tube 10. The bias voltage on the order of several volts is applied to the semiconductor device 200 between the collection anode 535 and the coaxial feedthrough central conductor 510. Same or higher than to photocathode voltage on the order of about 4-12 kV is typically applied to the collector of positive ions 400. Positive ions, generated on the electron incident surface 205 of the semiconductor device 200 will pass by the shortest trajectory and be collected by the collector of positive ions 400. Same or higher potential prevents photocathode bombardment by positive ions generated on the electron incident surface 205 of the semiconductor device 200 and prevents the photosensitive layer 110 and the photocathode 100 from degrading. It prevents damage to the photocathode 200, and provides a long time of operating and improves noise factor too.

The photosensitive layer 110 emits photoelectrons in correspondence with incident light. The electron incident surface 205 receives the photoelectrons from the photocathode 100. The electrons are accelerated by the applied field and bombard the electron incident surface 205 of semiconductor device 200.

When introducing elements of the present invention or the preferred embodiment(s) thereof, the articles "a," "an," "the," and "said" are intended to mean there are one or more of the elements. The terms "comprising," "including," and "having" are intended to be inclusive and mean that there may be additional elements other than the listed elements.

Although the present invention has been described in considerable detail with reference to a certain preferred embodiment thereof, other embodiments are possible. Therefore, the spirit and scope of the appended claims should not be limited to the description of the preferred embodiment(s) contained herein.

What is claimed is:

1. A photomultiplier tube, comprising:

a photocathode for emitting photoelectrons in correspondence with incident light;

a semiconductor device having an electron incident surface for receiving photoelectrons from the photocathode;

a cone shaped container, the container having a first opening and a second opening, the photocathode disposed at the first opening, the semiconductor device disposed at the second opening, the container being a vacuum container; and a collector of positive ions for preventing damage to the photocathode, the photocathode having a center, the collector of positive ions disposed in the center of the photocathode substantially perpendicular to the photocathode and extending entirely through the photocathode.

2. The photomultiplier tube of claim 1, wherein the second opening having an inner diameter not greater than a minimum outer diameter of the electron incident surface of the semiconductor device.

3. The photomultiplier tube of claim 2, wherein the second opening is disposed at the vertex of the container.

4. The photomultiplier tube of claim 3, wherein the photocathode includes a glass portion, a photosensitive layer and a photocathode electrode, the glass portion disposed on the photosensitive layer, the photosensitive layer electrically connected to the photocathode electrode.

5. The photomultiplier tube of claim 4, wherein the collector of positive ions is manufactured from a conductive material.

6. The photomultiplier tube of claim 4, wherein the collector of positive ions is manufactured from a metal alloy which shows a sharp change in the coefficient of expansion at certain temperatures.

7. A photomultiplier tube, comprising:

a photocathode for emitting photoelectrons in correspondence with incident light, the photocathode includes a glass portion having a convexo-concave shape, a photosensitive layer with an outer diameter, and a photocathode electrode, the glass portion disposed on the photosensitive layer, the photosensitive layer electrically connected to the photocathode electrode, the photocathode electrode being ring shaped and disposed around the outer diameter of the photosensitive layer;

a semiconductor device having an electron incident surface for receiving photoelectrons from the photocathode, the semiconductor device further including a top layer, a middle layer and a bottom layer;

a cone shaped container, the container having a first opening and a second opening, the second opening disposed at the vertex of the container, the photocathode disposed at the first opening, the semiconductor device disposed at the second opening; and a collector of positive ions for preventing damage to the photocathode, the photocathode having a center, the collector of positive ions disposed in the center of the photocathode substantially perpendicular to the photocathode and extending entirely through the photocathode, the collector manufactured from a metal alloy which shows a sharp change in the coefficient of expansion at certain temperatures.

8. The photomultiplier tube of claim 7, wherein the top layer is doped to be p-type $Al_{30}Ga_{70}As$ layer.

9. The photomultiplier tube of claim 8, wherein the middle layer is doped to be p-type GaAs.

10. The photomultiplier tube of claim 9, wherein the bottom layer is undoped GaAs.

11. The photomultiplier tube of claim 10, wherein the photomultiplier tube further includes a ceramic isolator, the semiconductor device mounted on the ceramic isolator.

12. The photomultiplier tube of claim 11, wherein the photomultiplier tube further includes a coaxial feedthrough central conductor, the coaxial feedthrough central conductor connected to the ceramic isolator, and in communication with the semiconductor device.

13. The photomultiplier tube of claim 7, wherein the container further includes an interior surface, the interior surface covered by resistive material.

14. The photomultiplier tube of claim 13, wherein the resistive material is graphite.

15. The photomultiplier tube of claim 7, wherein the photomultiplier further includes a confining electrode for confining the spread of photoelectrons and avoiding bombardment of electrons arriving at areas other than the electron incident surface.

16. The photomultiplier tube of claim 15, wherein the confining electrode is disposed near the vertex of the container.

* * * * *